United States Patent [19]

Geary

[11] 3,955,390

[45] May 11, 1976

[54] TWIST DRAWN WIRE, PROCESS AND APPARATUS FOR MAKING SAME

[75] Inventor: Arthur L. Geary, Barrington, Ill.

[73] Assignee: Brunswick Corporation, Skokie, Ill.

[22] Filed: Feb. 25, 1975

[21] Appl. No.: 553,022

Related U.S. Application Data

[62] Division of Ser. No. 334,223, Feb. 21, 1973, Pat. No. 3,883,371.

[52] U.S. Cl. ..... 72/64; 72/278

[51] Int. Cl.[2] ..... B21D 11/14; B21C 1/00

[58] Field of Search ..... 72/64, 278, 285; 140/149

[56] References Cited

UNITED STATES PATENTS 2,250,610 7/1941 Simons ..... 72/64

3,677,309 7/1972 Grandy ..... 140/149

FOREIGN PATENTS OR APPLICATIONS 228,846 4/1908 Germany ..... 72/64

*Primary Examiner*—Milton S. Mehr

*Attorney, Agent, or Firm*—J. G. Heimovics; D. S. Olexa; S. L. Epstein

[57] ABSTRACT

This invention comprehends torsional strengthening of two-phase metal materials. One application of the torsionally strengthened material is in the field of springs wherein the energy storage capacity is increased. The invention provides for methods and processes for increasing the torsional strength of two-phase metal materials. Also comprehended is an apparatus that provides the increased torsional strength by its novel combination of machines.

2 Claims, 2 Drawing Figures

TWIST DRAWN WIRE, PROCESS AND APPARATUS FOR MAKING SAME

CROSS REFERENCE TO CO-PENDING APPLICATION

This application is a divisional application of my copending application Ser. No. 334,223, filed Feb. 21, 1973, now U.S. Pat. No. 3,883,371.

BACKGROUND OF THE INVENTION

1. Field of the Invention

This invention relates to improved torsional characteristics of metals and a process and apparatus for strengthening metals, and more particularly, relates to metal wire with superior torsional yield strength, and a process and an apparatus for increasing the torsional yield strength characteristic of metals.

2. Background of the Invention

Twisting of wires to form a cable is well known in the wire drawing art; drawing a plurality of twisted wires through a die is also well known. In U.S. Pat. No. 2,250,610, it has been suggested to draw a single wire through a die or series of dies while twisting the wire and causing a back tension thereon. In addition, increase in corrosion resistance in stainless steel spring material is taught in British Pat. No. 722,427; precipitation of carbides in stainless steel is taught in U.S. Pat. No. 2,549,468; a method of increasing the tensile strength of a special type of 18-8 stainless steel is taught in U.S. Pat. No. 2,795,519 and an article entitled "High-Strength Stainless Wire And Strip Made of Iron — Chromium — Nickel — Based Alloys" by M. N. Reavskaya in the magazine "Steel in the U.S.S.R."; a method of heat treating a modified 5% chromium tool steel is discussed on pages 420–428 in the 1962 TRANSACTIONS OF THE ASM; and special dies, rollers, and devices for changing the strength characteristics of metals are taught in U.S. Pat. Nos. 300,741; 1,525,730; 1,749,671; 1,967,487; 367,733; 3,038,592 and 3,158,258. In fact, many different proposals have been presented, including the ones mentioned above, to mechanically work metal strips or wires in order to increase tensile strength thereof. However, the torque transmitting ability (torsional strength) of metal wire, such as required in springs, is of great significance and greater increase in torsional strength of wires used for such products is highly desirable but not recognized or satisfactorily achieved by this prior art.

SUMMARY OF THE INVENTION

This invention relates to improved torsional strength in metals and is concerned with a new and improved use of a two-phase metal structure which has improved torsional characteristics that are provided by a special process developed on a new machine combination. This invention not only recognizes but achieves increased torsional strength in metal wires that can be utilized in making superior springs, torque transmitting materials, etc.

It is therefore an object of this invention to provide a metal with increased torsional yield strength without substantially altering the tensile strength thereof.

It is another object of this invention to provide a method for increasing the torsional yield strength of metals.

Yet another object of the invention is to provide a machine combination that can provide an increase in torsional yield strength of a wire.

And yet another object of this invention is to provide a spring that exhibits increased energy storage characteristics.

It is a feature of this invention to increase the fatigue life of ultra high strength stainless such as is taught in U.S. Pat. No. 3,698,963.

The above and other and further objects and features will be more readily understood by reference to the following detailed description and the accompanying drawings.

DESCRIPTION OF THE PREFERRED EMBODIMENTS

Figure 1:
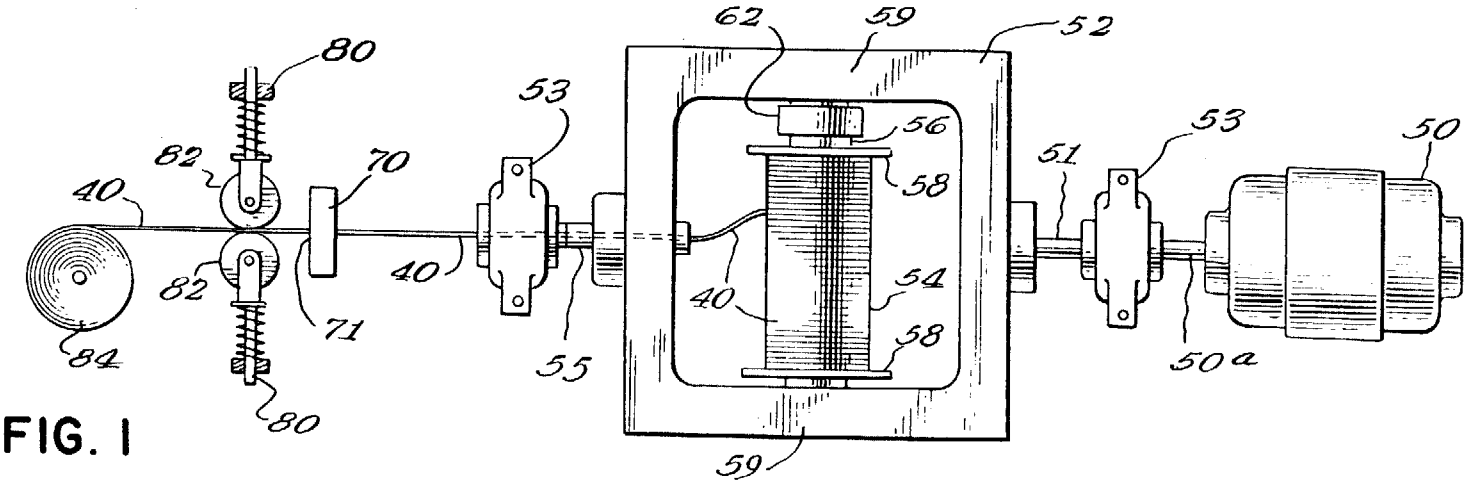
FIG. 1 is a pictorial representation of one embodiment of the invention; and, FIG. 2 is a cross-section of the wire and drawing die used in the embodiment of this invention of FIG. 1.

This invention comprehends as a preferred embodiment a two-phase metal wire that has been either cold worked, heat treated and cold worked, or heat treated to provide at least one of the two phases in an elongated fiberized configuration. The wire is then additionally drawn and simultaneously twisted in the reducing portion of a drawing die, and thus, exhibits an improved torsional yield strength compared to a wire of similar composition and cold work level that has not been die twisted. In addition, it has been found that the tensile strength of such a die twisted material exhibits substantially the same or a slightly lower tensile strength when compared to a similar non-die twisted wire.

Prior to the die twisting operation, the metal wire may be fiberized by processes such as drawing, swaging, rolling, heat treating, casting, etc., wherein the crystalline microstructure takes on an elongated fibered appearance that is parallel to the direction of the axis of the wire. This basic fiberizing can occur in either one or two phases of a two-phase material. During the die twisting operation the wire is pulled through a drawing die that reduces or constricts by plastic deformation the diameter of the wire within the reducing portion of the die only. At the same time, the wire is twisted prior to entering the die in such a fashion that only that portion of the wire that is being plastically deformed in the reducing portion of the die attains a permanent twist as it exits the die. In other words, quite surprisingly, it has been found that substantially all twisting of the wire must take place in the plastic region within the reducing portion of the die or the wire will have unstable, over and under twisted, portions along the length thereof. It is believed that the die twisting phenomena that occurs in the die results because the wire material is under plastic deformation or constriction in the one confined area.

Another embodiment of this invention is the method of increasing the torsional yield strength and, obviously, the ultimate torsional strength of a two-phase metal wire. After a metal wire is fiberized, the wire is placed on a spool which is arranged within a rotating yoke that imparts twist to the wire as it is being unspooled. Simultaneously, as the wire is unspooled, it passes through a drawing die that reduces the cross-sectional area of the wire, preferably ranging from ½ percent to 25 percent, and more preferably, ranging from 10 percent to 20 percent. The wire is reduced in cross-sectional area in the reducing portion of the die and concomitantly twisted. The helical twist angle is from about 5° to about 60° and more preferably from about 40° to about 50°. The twist is set in the wire also in the reducing portion of the die while the material is plastically flowing. As the wire exits the die, twist arrest rolls prevent over twist or under twist so that the wire is uniformly twisted and no unstable portions are formed along the length of the wire. If an unstable portion existed, then localized fracture would occur. The fiberizing operation depends upon the type of metal being used and can occur in metals undergoing diffusionless transformation which may be brought about by cold work or diffusion control transformations brought about by heat treatment. For example, materials having two phases wherein one phase is harder than the other and created by diffusionless transformation are: (1) beta titanium having a soft beta phase and a harder omega phase; (2) beta zirconium having a soft beta phase and a harder omega phase; (3) type 18–8 stainless steels having a soft austenite phase and a harder martensite phase; and (4) gamma uranium having a soft gamma phase and a hard gamma prime phase. Examples of diffusion transformations wherein two phases exist are found in metals including (1) medium and (2) high carbon steel having a soft ferrite phase and a harder pearlite phase; (3) silver-copper alloys having a soft silver phase and a harder copper phase; (4) silver-nickel alloys having a soft silver phase and a harder nickel phase; and, (5) aluminum-beryllium alloys having a soft aluminum phase and a harder beryllium phase. Alternatively, it is believed that other forms of producing fiberized characteristics in wire material other than by cold work and heat treatment can be employed, such as by controlled directional solidification. This process can be adapted to provide a helical fiberized structure.

It has been found that when an 18–8 stainless steel such as that described in U.S. Pat. No. 3,698,963 has not only cold worked but twist drawn on the last pass through a drawing die or even twist drawn and then finally reduced in a sizing die, that the helical disposition of the fiberized martensite phase results in improved ductility, fatigue life and fracture strength of the stainless steel. In other words, by combining the invention hereof with the teachings of U.S. Pat. No. 3,698,963 not only can the tensile strength of 18–8 stainless steel exceed 400,000 psi, but the ductility, fatigue life and fracture strength thereof are significantly improved, thus making this ultra high strength stainless steel an improved spring material.

When working with the type 18–8 stainless steel, it has been found that when volume fractions of martensite are less than 50%, residual stresses and work hardening due to torsional prestraining principally control the strengthening response due to die twisting. It has also been found that at volume fractions of martensite greater than 50%, the orientation of the harder phase strongly influences the strengthening response due to die twisting. Strengthening due to orientation is not only true for the 18–8 stainless steels, but for all the two-phase type metals. When dealing with type 18–8 stainless steel metals and, in fact, all the two-phase metals, once an appropriate strength level or the basic range of strength level has been obtained, either by thermo-mechanical treatment, cold working or heat treatment, die twisting of the wire or rod is performed in order to increase its preselected torsional strength properties. This occurs by orienting the fiberized metallographic microstructure of the metal wire in a helical configuration with respect to the axis of the wire. It has been found necessary that at least 15% of the harder of the two phases be present in the wire or only minimal torsional strengthening will occur. When type 18–8 stainless is being torsionally strengthened, it has been found desirable to have the wire contain at least 20% martensite. If strictly cold drawing is applied, it has been found desirable with the diffusionless transformation materials, such as stainless steel, to have at least 75% cold work or a 75% reduction in area by cold work imparted into the metal prior to the die twisting operation. The die twisting operation can involve a single or a multiple reduction pass of 5% to 30%, preferably the reduction will be 10% to 20% per pass while the wire is simultaneously being twisted.

It is further contemplated that after die twisting occurs a final sizing pass can be utilized wherein the cross-sectional area of the wire is reduced about 10% or less and preferably about 5% or less. Although die drawing is the preferred method of cold working the wire, other methods or combinations of methods as discussed above can also be appropriately used.

In addition to a wire, the material that can be torsionally strengthened can have the configuration of a rod, strip, thin flat strip, semi-flat strip, tube or any regular (i.e. square, circular, hexagonal, I-shaped, H-shaped) or irregular (i.e. C-shaped, angle-shaped, an axis of symmetry of one) cross-sectional configuration, as desired. Any suitable process known to those skilled in the art may be adopted wherein constriction and twisting occur simultaneously within the metal working portion thereof.

In all cases it has been found necessary that an elongated fiberized microstructure exist so that the fibers during the die twisting operation may be increased in length due to the drawing operation as well as the twisting operation. Thus, the fiberized microstructure of the die twisted wire gives an appearance where the fiberization is helically twisted with respect to the axis of the wire, and the fibers are longer in length than prior to die twisting.

It has been found that by varying the annealing temperature of type 18–8 stainless steel wire prior to any cold working, it is possible to control the stability of the stainless steel for both conversion to martensite from austenite and influence torsional yield properties obtained from the die twisting operation. It is possible to affect the hardness of the final martensite phase of type 18–8 stainless steel that has been formed by cold working and die twisting. It has also been found that the carbon content has an effect on the hardness of the martensite when the material is die twisted such that the torsional yield strength increases as the carbon content of the type 18–8 stainless steel increases.

In a preferred embodiment of the invention the dietwisting apparatus is shown in FIG. 1. A yoke 52 having a back stabilizing shaft 51 and a front tubular shaft 55 is supported by bearings 53. A prime mover 50 (which can be a variable speed motor) which is coupled to the back shaft 51 of the yoke 52 by shaft 50a provides rotational motion for the yoke 52. Yoke 52 contains a payoff spool 54 that has a core 56 and side flanges 58. The spool 54 is pivotally mounted in the flange plates 59 which comprise part of the yoke 52. The spool 54 is shown as overwrapped by coiled metal wire 40. At one end of the spool 54 is an adjustable back tension friction clutch 62 that provides for the proper back tension on the wire 40. The tubular front yoke 55 also serves as a wire guide. The spool 54 is mounted approximately normal to the rotational axis of the yoke 52 defined by the center line of shafts 51 and 55 thereby enabling the wire 40 to be pulled from the payoff spool 54 and aligned axially with the axis of drawing die 70. A twist arrestor 80 is located as close as possible to the exit end 71 of the drawing die 70. This aides in preventing any twist in the wire from occuring after it passes through the die 70. The arrestor 80 comprises at least a pair of spring loaded wheels 82 that squeeze or hold the wire tightly during the drawing-twisting operation. Many materials such as rubber, plastic, and metal can be successfully used; however, the wheel material and the spring force thereon will vary with the type of wire being drawn and its hardness. After the wire 40 passes through the twist arrestor 80 it is coiled on take-up spool 84 in a conventional manner. The twist arrestor rolls 82 are used to keep the wire 40 from overtwisting after it leaves the die 70, thereby confining the twist in the reducing zone of the die 70 and at the same time preventing an unstable zone to occur between the exit portion 71 of the die 70 and the take-up spool 84. In a wire drawing operation, the drawing die must be lubricated and therefore does not offer sufficient resistance with regard to preventing twists in the area between the die 70 and the take-up spool 84. Even by putting the take-up spool 84 close to the exit end of the die 70, the problem of twisting still occurs in that unstable areas can form partially around the take-up spool 84 where overtwisting can occur. Without the twist arrestor rolls 82 non-uniform twist occurs in the wire, thereby making an unsatisfactory product.

Figure 2:
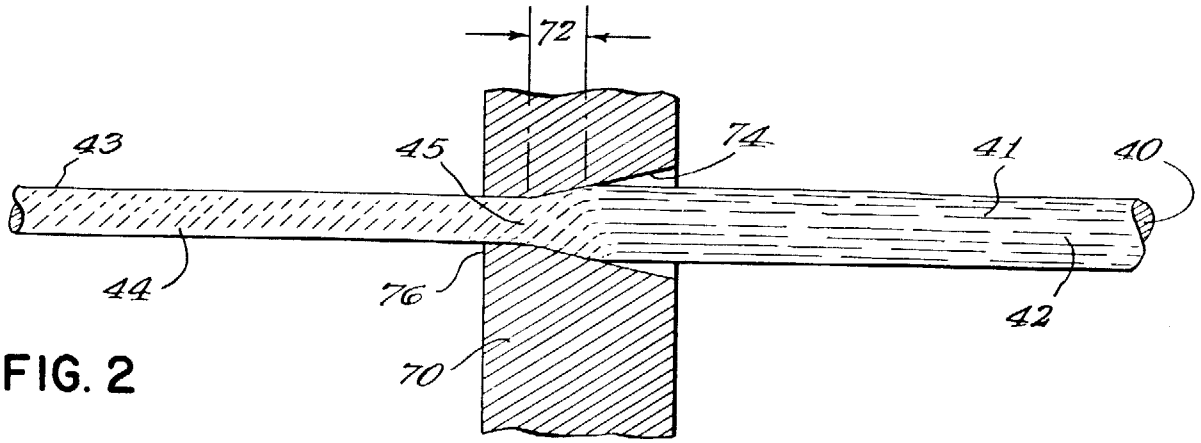

In FIG. 2, a segmented portion of wire 40 is shown passing through a segmented section of die 70. The die 70 comprises an entrance portion 74; a reducing portion 72 wherein the actual wire is reduced in diameter and also twisted, and a relief portion 76. The entering wire portion 41 is shown with pictorialized fibers 42 that are parallel to the axis of the wire 40. As the constricted and twisted portion 43 leaves the die 70 the twisted and elongated fibers that were designated 42 now appear as fibers 44 and are helical with respect to the axis of the wire 40. In the reducing portion 72 of the die 70 these elongated fibers 42 are being twisted as depicted as intermediate fibers 45. Thus, it may be seen that as the wire 40 is pulled through the die where plastic deformation enables both constriction and twisting or torsion to occur simultaneously transforming parallel fibers to helical fibers. It should also be noted that although the twist is imparted by the yoke 52 rotating normal to the spool 54, the fiber lines on the wire are not twisted or helically wrapped until the wire enters the reducing portion 72 of the die 40 and is plastically deformed therein. Thus, both constriction and torsion take place within the reducing portion of the die simultaneously.

The payoff spool rotational speed, the linear speed of the wire being drawn at the die exit and the outer twist angle of the wire are inter-dependent variables of the twist drawing process. To achieve a specific twist (TPI) many combinations of payoff spool rotational speed and drawing speed are possible.

In the single pass wire twisting operation and as discussed herein, all twists in the wire will be understood to mean a uniformly applied twist which is set in the wire substantially within the reducing section of the die. The twist is referred to in turns per unit length, usually turns per inch, or TPI, and is measured as the twist-drawn wire exits from the die. When twisting wire, the technique used for determining the amount of twist that is impressed in the wire consists of measuring the RPM of the spool twisting head or yoke 52, and the RPM of the drawing capstan or take-up spool 84. The diameter of the capstan 84 is easily obtained; therefore, the line speed of the wire exiting the die can easily be calculated. Impressed twist is the quotient of RPM and linear speed (inches per minute) of the exiting wire. In this analysis, it is assumed that all the applied twist is set in the wire substantially within the die and no slippage through the die occurs.

In multiple pass wire twisting operations, an initial die twist is first set in the wire and then followed by one or more single pass wire twisting operations which can be repeated, as desired.

Multiple or incremental twisting, such as referred to hereinabove, would obviously allow for die twisting to larger helix angles at fast wire drawing speeds due to the smaller amount of package rotation and twist per pass.

The twist angle imparted during the die twisting operation may be characterized by either TPI (turns per inch) or the helix angle $\alpha$. These two parameters are related as follows:

Tan $\alpha = 2\pi r$ x (TPI)— wherein, $r$ is the wire radius $\alpha$ is the helix angle at the wire surface with respect to the wire axis; and, TPI is turns per inch.

For a helix angle of 45°, the TPI is inversely proportional to the wire or rod diameter, $d$;

$$\text{TPI} = \frac{1}{\pi d}$$

The following examples of wire products are intended only to illustrate the invention and not limit the scope thereof in any way.

EXAMPLE I

A type 18–8 stainless steel .257 inches diameter wire having a general chemical composition by weight of:

carbon 0.08%; manganese 1.58%; silicon 0.67%; nickel 8.9%; chromium 18.02%, and a remainder of iron was annealed at 1900°F at a rate of 2 seconds per mil. The wire was cold worked to 0.064 inch diameter which related to a 93.8% reduction in area from the 0.257 inch diameter. The following physical properties were measured:

| TPI (turns per inch) | Torsional Yield Strength psi | Tensile Yield Strength psi |
|---|---|---|
| 0 | 133,000 (c)* | 260,000(c)* |
| 2½ | 146,000 (ct)** | 252,000(ct)** |
| 5 | 182,000 (ct)** | 222,000(ct)** |

*(c) designates material reduced in size solely by constriction.

**(ct) designates material reduced in size by both constriction and torsion.

EXAMPLE II

A type 18–8 stainless steel 0.257 inch diameter wire having a chemical composition the same as Example I was annealed at 1800°F at a rate of 2 seconds per mil. The wire was cold worked to 0.114 inch, 0.091 inch, 0.064 inch and 0.060 inch diameters which reflected 80%, 87.3%, 93.8% and 94.5% respectively, reductions in areas from the original 0.257 inch wire diameter. The following physical properties were measured for each diameter:

| Diameter (Inches) | TPI | Cold Work [1] | Torsional Yield Strength psi | Tensile Yield Strength psi |
|---|---|---|---|---|
| 0.114 | 0 | 80% | 121,000(c) | 249,000(c) |
| 0.114 | 3 | 93.8% | 137,000(ct) | 242,000(ct) |
| 0.091 | 0 | 87.3% | 111,000(c) | 291,000(c) |
| 0.091 | 3.5 | 95.4% | 143,000(ct) | 263,000(ct) |
| 0.064 | 0 | 93.8% | 139,000(c) | 311,000(c) |
| 0.064 | 5 | 97.8% | 155,000(ct) | 300,000(ct) |
| 0.060 | 0 | 94.5% | 149,000(c) | 296,000(c) |
| 0.060 | 4.5 | 97.1% | 169,000(ct) | 280,000(ct) |

[1] Includes surface cold work due to die-twisting.

EXAMPLE III

A type 18–8 stainless steel 0.257 inch diameter wire having a chemical composition the same as Example I was annealed at 1950°F at a rate of 2 seconds per mil. The wire was cold worked to 0.091 inch and 0.064 inch diameters which reflected 87.6% and 93.8% respectively, reductions in areas from the original 0.257 inch wire diameter the following physical properties were measured for each diameter:

| Diameter | TPI | Cold Work[1] | Torsional Yield Strength psi | Tensile Yield Strength psi |
|---|---|---|---|---|
| 0.091 in. | 0 | 87.6% | 112,000(c) | 279,000(c) |
| 0.091 | 1.8 | 92.6% | 140,000(ct) | 257,000(ct) |
| 0.091 | 3.5 | 95.4% | 151,000(ct) | 258,000(ct) |
| 0.064 | 0 | 93.8% | 143,000(c) | 282,000(c) |
| 0.064 | 5 | 97.8% | 171,000(ct) | 276,000(ct) |

[1] Includes surface cold work due to die-twisting.

EXAMPLE IV

A high carbon heat treated steel wire having a general chemical composition by weight of: carbon 0.88%; manganese 0.37%; phosphorus 0.008%; sulphur 0.012%; silicon 0.210% and remainder iron was cold worked to a 0.114 inch diameter. The following physical properties were measured:

| TPI | Helix Angle | Torsional Yield Strength psi | Tensile Yield Strength psi |
|---|---|---|---|
| 0 | 0 | 120,000(c) | 216,000(c) |
| 2 | 36 | 125,000(ct) | 207,000(ct) |
| 2½ | 42 | 134,000(ct) | 156,000(ct) |

Physical properties recited in each of the 18–8 stainless steel examples I, II, and III, clearly indicate that when the solely constricted wire was subjected to die twisting, the torsional yield strength exhibited marked increase while the untwisted sample yielded a significantly lower torsional yield strength. The tensile yield strength of the twisted samples was, as expectedly, reduced when compared to the untwisted sample.

These examples also indicate that the amount of twist need not be excessive to show a rather marked increase in torsional yield strength. Thus, die twisting obviously increases the physical properties of wires when they are to be used in torsional applications.

It was found from these examples that the torsional yield strength of wires exhibited up to 50% greater strength when tested in the direction of torsional prestraining or twist, as opposed to testing in the direction opposite to torsional prestraining or twist. In each example it was determined that the volume fraction of martensite was greater than 50% and that the material contained more than 0.06 weight percent of carbon; therefore, the orientation of the harder phase, martensite, strongly influenced the strengthening response of the material. This was to be expected, as it has been found characteristic in all two-phase materials, that the harder of the two phases when present in volume fractions of 50% or more strongly influence the strengthening response of the metal.

The heat treated and cold drawn high carbon samples of Example IV confirm that the characteristic of the increased torsional yield strength is present in all two-phase metals and that the mechanism, cold work and/or heat treatment, only depends on the type of metal to be used.

When a wire with increased torsional strength is formed into springs, it has been found that there is increased energy storage capacity of the spring. This increased energy storage in the springs can be expected and is evidenced by Example V as described hereinafter.

EXAMPLE V

An 18–8 stainless steel wire having a composition by weight of:

carbon 0.077%; manganese 0.82%; phosphorus 0.023%; sulphur 0.025%; silicon 0.54%; chromium 18.32%; nickel 9.34%; molybdenum 0.23%; cobalt 0.11%, with the remainder iron was made into a series of springs. Some of the physical and mechanical properties of the springs were:

| | Wire Characteristics | | | Spring Characteristics | |
|---|---|---|---|---|---|
| Spring No. | Wire Size Inches | Cold Work | TPI | Spring Diameter | Active Coils |
| A | 0.0324 | 85% | 0 | .43 | 6 |
| B | 0.0324 | 85% | 1 | .43 | 6 |
| C | 0.0324 | 85% | 4½ | .43 | 6 |
| D | 0.0324 | 85% | 9 | .43 | 6 |

The energy storage level for each spring was measured and the percentage increased in energy storage was found to be:

a Spring B displayed a 31% increase over Spring A
b Spring C displayed a 38% increase over Spring A
c Spring D displayed a 66% increase over Spring A.

From Example V it can be easily recognized that when die-twisting is applied to all two-phase metals comprehended herein, including ultra high strength type 18–8 stainless steels, of 400,000 psi or more, that torsional properties, including fatigue life, can significantly be increased.

Therefore, standard spring design technology cannot be applied to springs described herein because the torsional yield strength greatly exceeds the strength relationships of standard spring material.

Although specific embodiments of the invention have been described, many modifications and changes may be made in the compositions of metals and yet still are contemplated herein, the exact method of die-twisting can be altered by substituting rolling, swaging, or casting processes, and the machinery can be modified without departing from the spirit and the scope of the invention, as defined in the appended claims.

I claim:

1. A machine combination for increasing the torsional yield strength of a metal wire comprising:

a a yoke having a longitudinal axis of rotation;

b a spool for supporting a coil of wire, said spool rotatably mounted on the yoke and substantially normal to the axis of rotation;

c a die having a reducing zone parallelly alligned with the yoke axis;

d means for rotating the yoke while wire being unspooled from the spool passes through the die; and, e twist arresting rolls closely adjacent the exit end of the die for preventing plastic twist in the wire after it exits the die, and preventing excess twist accumulation in the wire which will cause failure thereof.

2. The combination of claim 1 wherein the means for rotating is a prime mover.

* * * * *